US007765849B2

(12) United States Patent
Schürmann et al.

(10) Patent No.: US 7,765,849 B2
(45) Date of Patent: Aug. 3, 2010

(54) PLATE-CRIMPING PRESS FOR MAKING PIPE

(75) Inventors: Klaus Schürmann, Jüchen (DE); Lothar Sebastian, Duisburg (DE); Klaus Wollny, Krefeld (DE)

(73) Assignee: Siempelkamp Maschinen-und Anlagenbau GmbH & Co. KG, Krefeld (DE)

( * ) Notice: Subject to any disclaimer, the term of this patent is extended or adjusted under 35 U.S.C. 154(b) by 352 days.

(21) Appl. No.: 12/069,900

(22) Filed: Feb. 13, 2008

(65) Prior Publication Data

US 2008/0202359 A1 Aug. 28, 2008

(30) Foreign Application Priority Data

Feb. 16, 2007 (DE) ..... 10 2007 008 312
May 26, 2007 (DE) ..... 20 2007 007 517 U

(51) Int. Cl.
*B21D 5/12* (2006.01)
*B21D 37/00* (2006.01)

(52) U.S. Cl. ..... 72/381; 72/130; 72/179; 72/379.2; 72/385; 29/890.038

(58) Field of Classification Search ..... 72/130, 72/178, 179, 181, 379.2, 381, 385; 29/890.038
See application file for complete search history.

(56) References Cited

U.S. PATENT DOCUMENTS 3,472,053 A * 10/1969 Chang ..... 72/178
3,911,709 A * 10/1975 Randerath ..... 72/179
4,148,426 A * 4/1979 Midzutani et al. ..... 72/368
4,476,703 A * 10/1984 Williamson ..... 72/130
4,590,781 A * 5/1986 Toyooka ..... 72/181
7,004,005 B2 * 2/2006 Feldmann et al. ..... 72/389.1
7,587,820 B2 * 9/2009 Ooyauchi et al. ..... 29/890.038

* cited by examiner

*Primary Examiner*—David B Jones
(74) *Attorney, Agent, or Firm*—Andrew Wilford

(57) ABSTRACT

A press for crimping longitudinal edges of a plate for the manufacture of pipe has a closed press frame, an upper press platen, and a lower press platen extending longitudinally through the frame. A pair of transversely spaced and transversely shiftable upper supports are provided on the upper platen, and a pair of transversely spaced and transversely shiftable lower supports on the lower platen. Respective upper dies are fixed in the upper supports and have downwardly directed lower faces, and respective lower dies are fixed in the lower supports and have upwardly directed upper faces. A piston/cylinder assembly braced between the frame and one of the platens and pressurizable to shift the one platen vertically toward the other of the platens. Hydraulic actuators may position the holders and their dies transversely and also lock them in place.

16 Claims, 7 Drawing Sheets

PLATE-CRIMPING PRESS FOR MAKING PIPE

FIELD OF THE INVENTION

The present invention relates to a press. More particularly this invention concerns a crimping press for bending the edges of a plate for making pipe.

BACKGROUND OF THE INVENTION

Large-diameter pipe is typically made by crimping, that is bending up, the longitudinal edges of a rolled plate, termed a "skelp," which in the case of pipe of very large diameter may be formed by two or more strips whose longitudinal edges are welded together. This gives the workpiece a cross sectional shape having a flat and planar center portion with a pair of normally upwardly bent edges of part-cylindrical shape having a radius of curvature corresponding to that of the pipe to be produced. This crimped workpiece is then fed to a press that bends it into a U-section, then to a press that bends it into an O-section of basically circular shape with the longitudinal edges abutting or closely juxtaposed. In a final stage the two longitudinal edges are butt-welded together to form a the finished circular-section pipe.

The crimping of the longitudinal plate edges in the first shaping step represents an important step in the process of pipe production, and thus optimizing this step optimizes the production of pipe. In a crimping press, an upper die and a lower die is are provided for each of the two longitudinal plate edges, with the upper die having a downwardly directed convex face and the lower die having a complementary upwardly directed concave face, or vice versa.

To be able to adapt a press to the varying width of the plates, it is known to position each of the two plate edges in an independent press that is designed as a C-frame press. All C-frame presses are generally moved transversely, that is crosswise to the longitudinal direction of the plate workpiece and its edges, and are shifted transversely for adjustment, as described in U.S. Pat. No. 3,911,709 and GB 1,537,055. With the currently known systems, there is room for improvement with respect to stability, for example.

OBJECTS OF THE INVENTION

It is therefore an object of the present invention to provide an improved plate-crimping press for making pipe.

Another object is the provision of such an improved plate-crimping press for making pipe that overcomes the above-given disadvantages, in particular that has a stable and compact structure and that can be adjusted to various conditions in a simple and efficient manner.

SUMMARY OF THE INVENTION

A press for crimping longitudinal edges of a plate for the manufacture of pipe. The press has according to the invention a closed press frame, an upper press platen and a lower press platen extending longitudinally through the frame, a pair of transversely spaced and transversely shiftable upper supports on the upper platen, a pair of transversely spaced and transversely shiftable lower supports on the lower platen, respective upper dies fixed in the upper supports and having downwardly directed lower faces, respective lower dies fixed in the lower supports and having upwardly directed upper faces, a piston/cylinder assembly braced between the frame and one of the platens and pressurizable to shift the one platen vertically toward the other of the platens.

In practice there is a framework formed by a row of parallel press frames each lying on a vertical plane perpendicular to the longitudinal extent of the workpiece. Each such frame is made from annular frame plates, with these frame plates having an upper beam or member, a lower beam or member and connecting members or columns on both sides. These frame plates may be in one piece or comprised of a plurality of plate segments that may for example be welded together. However, each closed press frame can also be formed by a respective upper member, lower member, and press columns that connect the upper member and the lower member like a column press.

The invention first proceeds from the discovery that the press forces created during shaping can be absorbed especially well if the shaping is done when the press frames are closed and thus the frames absorb the press forces created at both longitudinal edges. This is in particular of advantage when relatively thick plates are bent to produce thick-walled pipe. Despite the frame construction, it is possible to adjust the press to varying conditions, and in particular varying plate widths and varying bending radii in a simple manner because the die holders and thus also the dies attached to the die holders can be adjusted within the press frame and thus can be freely positioned. This positioning can be done remotely, thus obviating the need for costly manual adjustments. Instead, the die holders can be positioned in the desired manner by external control. To that end, the actuators can be connected with one or more suitable normally hydraulic control means. It is of special significance that the actuators assigned to the die holders according to the invention not only position the holders but also arrest or fix them in position as the press is closed and the plate workpiece is crimped. Consequently, it is not necessary to mechanically lock, i.e. clamp, the positioned die holders, for example. Rather, with hydraulic piston/cylinder assemblies as actuators, for example, the actual piston/cylinder assemblies can take care of both the positioning and the hydraulic fixing. Consequently, the piston/cylinder assemblies are locked hydraulically.

The piston/cylinder assemblies are preferably NC-controlled hydraulic piston/cylinder assemblies. The positioning of the dies can be kept constant even during the application of press forces via the press cylinders within a range of 0.10 mm, for example, without requiring mechanical clamping. With the help of the actuators, such as hydraulic piston/cylinder assemblies, it is not only possible to position and then arrest the die holders, but in the scope of the invention, there is also the option of displacing one or more the die holders transversely during the pressing process, that is as the press is closing. In this way, the pressing process can be adjusted flawlessly to varied conditions. The actuating piston/cylinder assemblies can be double-acting or differential piston/cylinder assemblies each having a pair of pressurizable compartments flanking the respective piston.

In a preferred embodiment, at least one end of each of the actuators is secured to the respective press platen. If the actuators are piston/cylinder assemblies, the invention proposes fixing the piston or the piston rod of the piston/cylinder assemblies to the respective press platens and connecting the die holder fixedly with the cylinder or the cylinder housing, so that the cylinder housing travels with the die holder during positioning, while the piston or the piston rod remains stationary relative to the press framework. In this context, it is particularly useful if the upper and/or lower press platen has at least one central abutment block against which the respective actuators are braced. Thus there are two upper die holders and two lower die holders for the simultaneous processing of both plate edges, with preferably one or more independent piston/cylinder assemblies being provided for each die holder. The two die holders for the two plate edges flank the respective central abutment block.

In this way, the piston/cylinder assemblies can act on the respective abutment blocks transversely from both sides. Consequently, the piston rod of the respective piston/cylinder assembly can be connected to the abutment block at each side. The advantage of this is that, when crimping two plate edges, the forces applied to the die holder during pressing can be centrally absorbed by the abutment block and essentially compensated out there. Here, the invention proceeds from the discovery that the forces that are essentially introduced vertically into the plate edges during crimping are largely diverted into horizontal and/or transverse forces because of the shapes of the dies. The forces created at the two plate edges are opposite forces, and thus they can be largely compensated out if they are applied to the shared abutment block. Thus, the invention prevents the frames, and especially the vertical frame components and/or columns, from having to resist high forces. This guarantees an especially stable construction. Vice versa, an especially compact construction can be chosen to obtain specific press forces, because the compensation of forces allows a very compact construction of the press framework. This makes it possible to prebend large parts of the plate even during crimping and, consequently, the subsequent process steps can also be optimized with the press in accordance with the invention.

It has already been explained that it is useful in the scope of the invention if the pistons are fixed on the press framework, for example supported by their piston rods on the press framework, such as at its central abutment block, for example. To that end, it may be useful in the scope of a modified embodiment of the invention if the piston rods are tubular or hollow and that at least one tie rod extends through the piston rods. If, for example, the piston rods assigned to the two cylinder arrangements flank the respective central abutment block, it is useful if the pistons and piston rods are braced against the abutment block by means of the tie rods that extend through the piston rods, with the tie rods being fastened to the respective pistons. In a preferred embodiment, one single shared tie rod extends through the tubular piston rods flanking the abutment block, with the ends of the tie rod being fastened to the pistons, and with the tie rod bracing the two pistons and tubular piston rods against the central abutment block and also against one another. To that end, the abutment block may also have an passage to accommodate the central tie rod.

The piston/cylinder assemblies are preferably double-acting piston/cylinder assemblies so that each individual die holder can be adjusted independently. It goes without saying that the piston/cylinder assemblies assigned to a die and/or, for example, at the lower press part of a plate side, are preferably operated synchronously by a common controller.

The invention furthermore proposes that a stroke-measuring system be assigned to one or more piston/cylinder assemblies, preferably to each piston/cylinder assembly, to determine the position of the piston within the cylinder housing. For example, this can be a precision lead screw assigned to the piston and/or the piston rod.

It is furthermore useful to arrest the plates to be processed in position in the press during processing. To that end, one or more plate-clamping means may be provided.

The invention furthermore not only comprises embodiments with hydraulic actuators for the die holders, but also embodiments where the actuators are spindle drives, with the spindle being each being driven by a respective electric motor.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
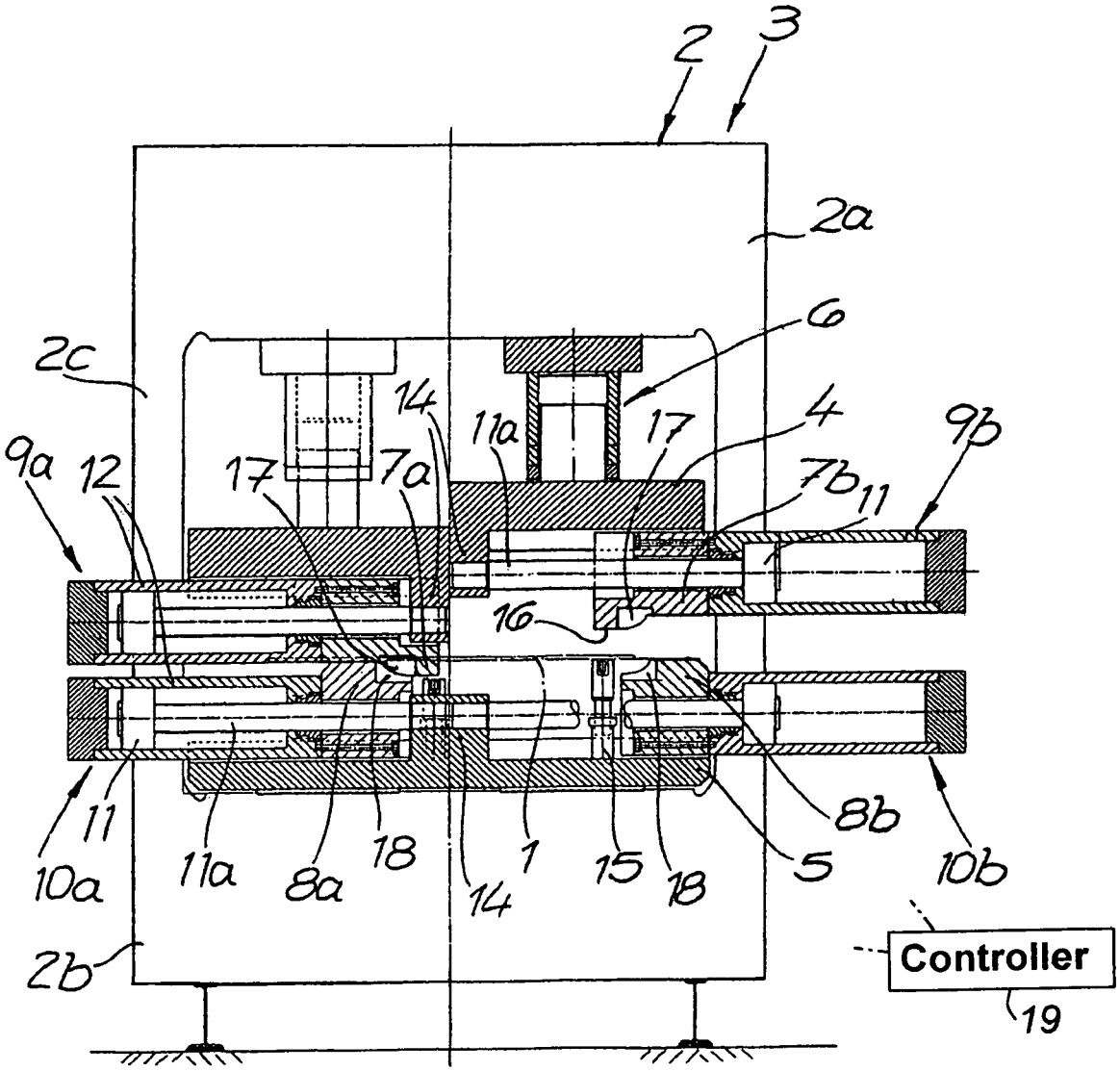
FIG. 1 is a preferred embodiment of the invention in vertical cross-section.
Figure 2:
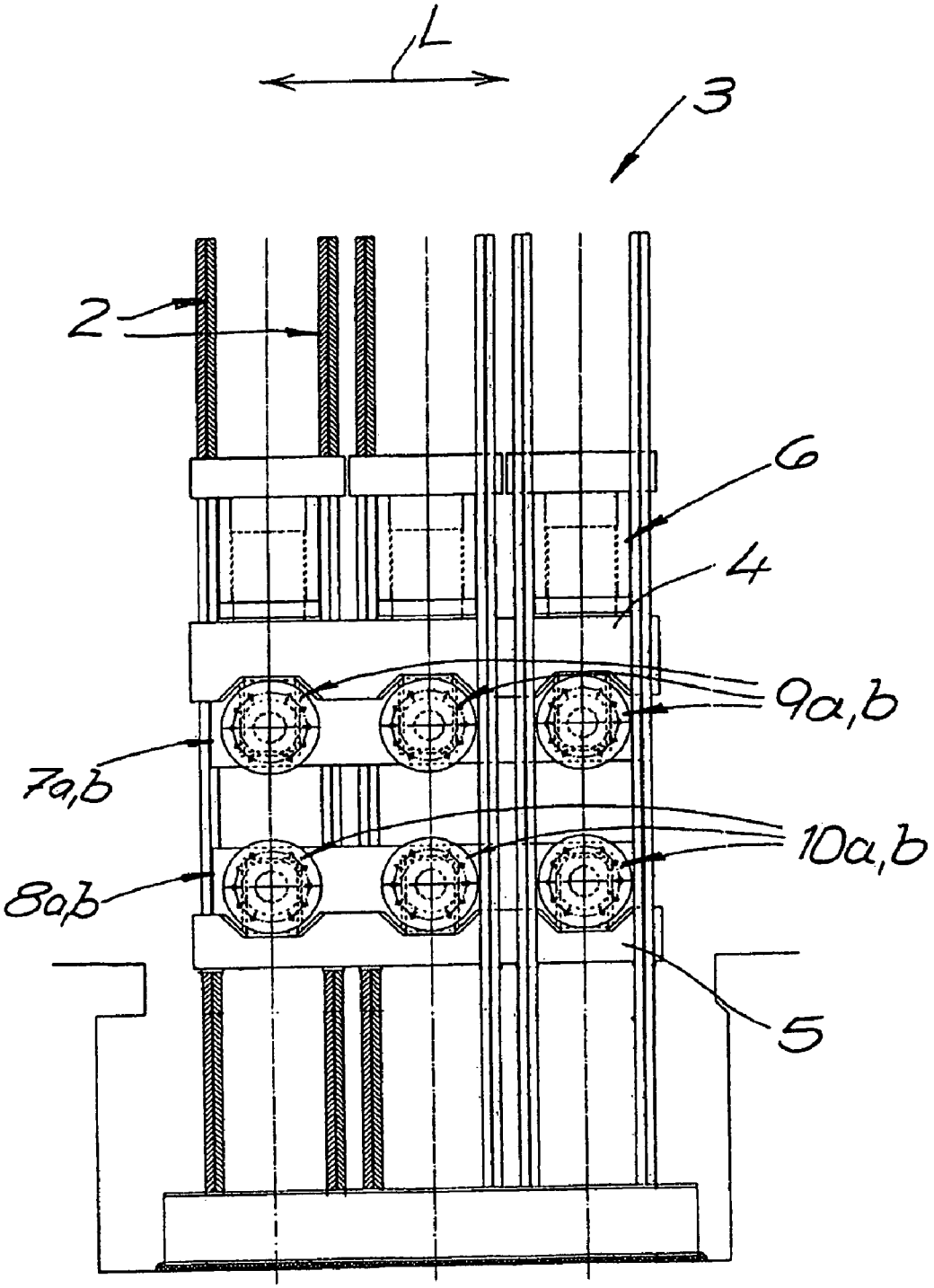
FIG. 2 is a partly sectional side view of the structure of FIG. 1.

As seen in FIGS. 1 and 2 the press in accordance with the invention has a framework 3 that is comprised of a row of closed press frames 2 lying in respective vertical planes extending perpendicular to a longitudinal direction L. Furthermore, the press has a rigid steel upper press platen 4 and a rigid steel lower press platen 5, with a plurality of downwardly extensible shaping piston/cylinder assemblies 6 supported on the press frames 2 and bearing on the upper press platen 4 (or bearing upward on the lower press platen 5 in an alternative embodiment). The press according to the invention has the piston units 6 fixed above the upper platen 4 with their pistons fixed to this upper platen, and the lower press platen 5 is fixed so the upper press platen 4 that can be raised and lowered relative to the plate workpiece 1 that lies in a horizontal plane.

Two upper die holders 7*a* and 7*b* for two upper dies 17 are provided on the upper press platen 4. Two lower die holders 8*a* and 8*b* for two lower dies 18 are provided on the lower press platen 5. With the help of the press in accordance with the invention, both longitudinal edges of a plate 1 are crimped simultaneously, with the die holders 7*a* and 8*a* being located at one longitudinal edge (i.e., in FIG. 1, the left longitudinal edge) and the die holders 7*b* and 8*b* being located at the other longitudinal edge (i.e., in FIG. 1, the right longitudinal edge). To that end the upper dies 17 have a part-cylindrical convex shape, and the lower dies 18 have a complementary concave shape.

The closed press frames 2 are annular and basically rectangular. FIG. 1 shows a preferred embodiment where the closed press frames are formed by frame plates that can be formed either by single pieces or by multiple pieces of an upper cross plate 2*a* and a lower cross plate 2*b* as well as two side plate limbs or columns 2*c*. In accordance with the invention, the die holders 7*a* and 7*b*, 8*a* and 8*b* and thus also the dies 17 and 18 can then be shifted to accommodate plate workpieces of different widths despite the closed construction. To that end, the horizontal position of all the die holders can be adjusted transversely to the horizontal longitudinal direction L of the press and thus in a horizontal transverse direction of the press by means of respective actuators 9*a*, 9*b*, 10*a*, and 10*b*. Thus according to the invention the die holders 7*a*, 7*b*, 8*a*, and 8*b* are positioned and/or adjusted within the press frames 2 and/or relative to the press frames 2 and also relative to the press platens 4 and 5. To that end, respective actuators 9*a*, 9*b*, 10*a*, and 10*b* are provided according to the invention.

In the two embodiments according to FIGS. 1 to 4, the actuators are hydraulic piston/cylinder assemblies that operate transversely of the press and also in a horizontal plane and/or parallel to the workpiece plane. The hydraulic piston/cylinder assemblies 9*a*, 9*b*, 10*a*, 10*b* not only position the die holders 7*a* and 7*b*, 8*a* and 8*b*, but also simultaneously lock and/or arrest them in place without further mechanical aids. However, the option of displacing the die holders 7*a* and 7*b*, 8*a* and 8*b* during a pressing operation with the help of the hydraulic piston/cylinder assemblies 9*a* and 9*b*, 10*a* and 10*b* is also provided within the scope of the invention.

The piston/cylinder assemblies 9*a*, 9*b*, 10*a*, and 10*b* are supported at and/or held by the upper and/or lower press platen 4 and 5. To that end, the upper and the lower press platen have a respective central abutment block 14 or a plurality of central abutment blocks so that the upper press platen 4 and lower press platen 5 in the embodiment are essentially T-shaped or partially T-shaped in cross-section. The abutment block 14 is an integral component of the respective press platen 4 and 5, or is firmly connected to the respective press platen 4 or 5 as a separate part. The piston/cylinder assemblies 9*a*, 9*b*, 10*a*, and 10*b* are then braced against the respective press platens 4 and 5 at the abutment block 14. It is of special significance here that the piston/cylinder assemblies 9*a*, 9*b*, 10*a*, and 10*b* and their pistons 11 and/or the piston rod 11*a* are solidly connected to the respective press platen 4 and 5 and/or to the respective abutment block 14. The die holders 7*a* and 7*b*, 8*a* and 8*b* are firmly connected to the cylinder housing 12 of the piston/cylinder assemblies 9*a*, 9*b*, 10*a*, and 10*b*. Thus, when they are operated, the cylinder housing 12 and the die holders 7*a* and 7*b* and/or 8*a* and 8*b* fastened thereto are displaced relative to the fixed piston rods 11*a*.

FIG. 1 indicates several aspects of various functional positions. For example, the left piston/cylinder assemblies 9*a*, 10*a* show the respective die holders 7*a* and 8*a* in an innermost position, while the right piston/cylinder assemblies 9*b*, 10*b* show a functional position with maximally outwardly displaced die holders 7*b* and 8*b*. Furthermore, the sectional view of FIG. 1 indicates in the left half the vertically operating press cylinder 6 when the press is closed and in the right half when the press is open to provide a clear overview of various functional positions in one view. The same applies to FIG. 3, but reversed.

FIG. 1 shows that the vertical forces introduced into the die holder during pressing are revectored by the die shape into an essentially horizontal direction and then transmitted via the piston rods 11*a* to the press platens 4 and 5 and/or their abutment blocks 14. Because of the symmetrical arrangement and/or the arrangement on both sides and/or the connection of the piston rods 11*a* to the abutment block 14 on both sides, the forces are balanced against each other in the area of the abutment block 14 where the inner ends of the rods 11*a* are fixed so that most forces are not transmitted to the frames 2 and especially to the side frame columns 2*c*. This is also possible because the cylinder housings 12 are not rigidly connected to the frames 2, but instead can move freely, and only the piston rods 11*a* are firmly connected to the press platens 4 and 5 in the central area within the press.

FIG. 1 furthermore indicates that a plate-clamping arrangement 15 may be provided to hold the plate 1 in place within the press. This plate-clamping means may also be formed by (hydraulic) piston/cylinder assemblies. It is possible to lock the plate in place with a respective piston/cylinder assembly from the top and from the lower. This embodiment is not shown. Rather, only lower piston/cylinder clamps 15 that arrest the plate 1 against the upper die holder by fixing it against a stop 16 on the holders 7*a* and 7*b* are provided in FIG. 1.

FIG. 2 furthermore shows that three piston/cylinder assemblies 9*a*, 9*b*, 10*a*, 10*b* are assigned as operating cylinders to the die holders 7*a* and 7*b*, 8*a* and 8*b* extending longitudinally in the direction L. The number of these piston/cylinder assemblies can be varied and adjusted to the conditions.

Figure 3:
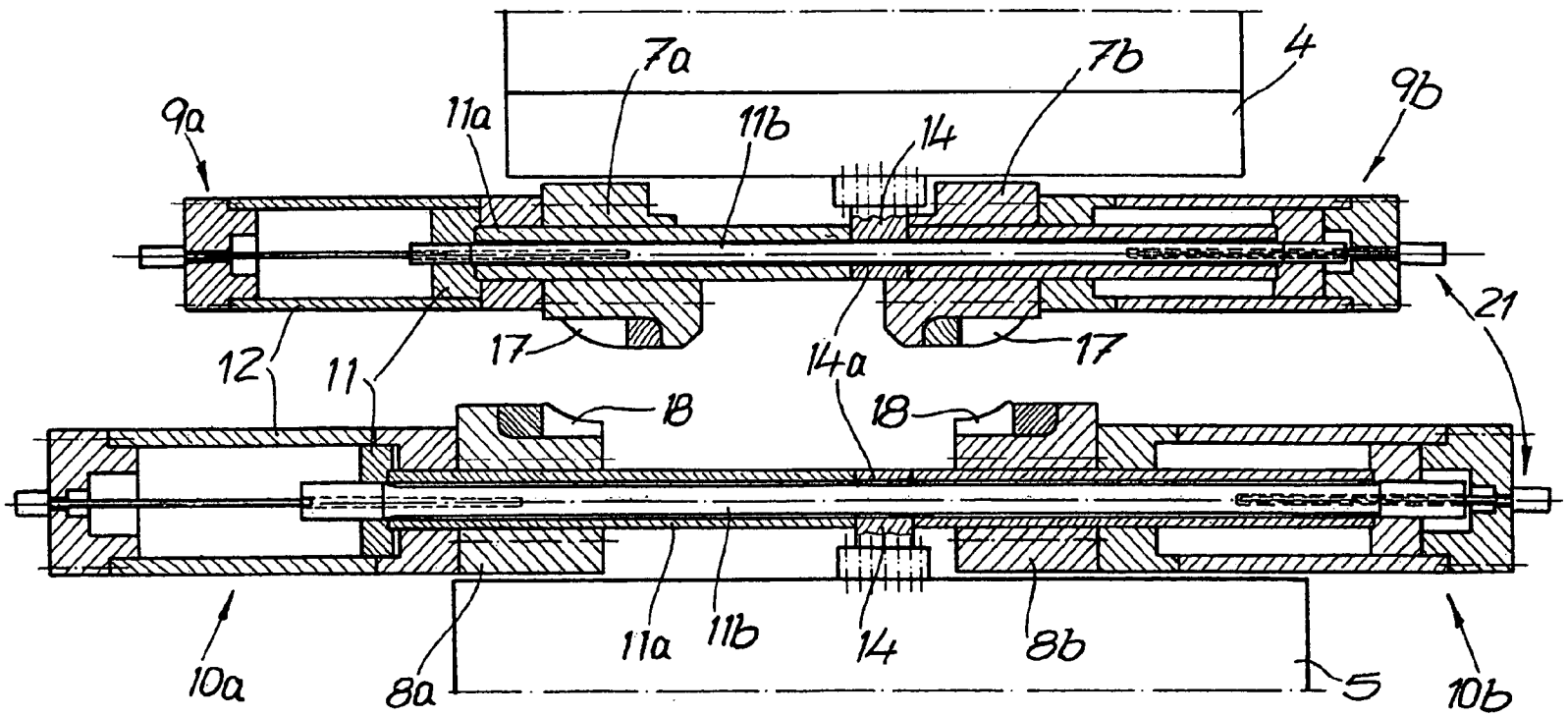
FIG. 3 is vertical section through a modified embodiment of the structure of FIG. 1.
Figure 4:
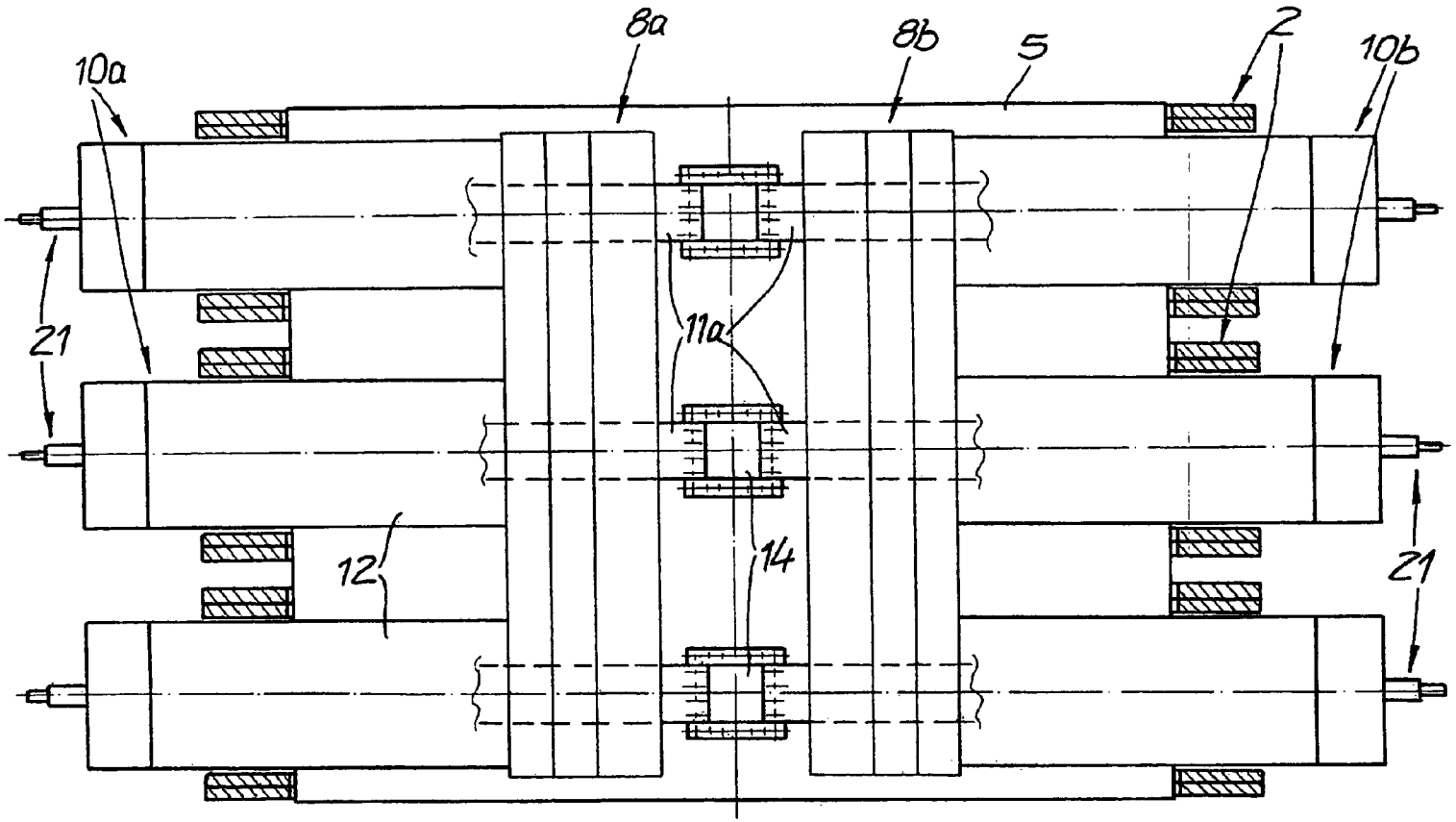
FIG. 4 is a simplified top view of the structure according to FIG. 3.

The principal structure of the embodiment shown in FIGS. 3 and 4 corresponds to the embodiment according to FIGS. 1 and 2. Again, varying functional positions of the right and left press side are arranged. The press is open. The actuators are also piston/cylinder assemblies, with the piston rods 11*a* and pistons 11 again being fixed in on the press platens 4 and 5, while the cylinder housings 12 are displaced to position the respective dies 17 and 18. In the embodiment according to FIGS. 3 and 4, the piston rods 11*a* are tubular or hollow, and a tie rod 11*b* extends through the piston rods 11*a*. To that end, reference is made in particular to FIG. 3. The piston 11 and piston rod 11*a* are each made as separate components. FIG. 3 shows that a single shared central tie rod 11*b*, for example, extends through the piston rods 11*a* provided on the lower press part 5 and flanking the abutment block 14. This tie rod is connected firmly to the two pistons 11 at both ends. Thus, the tie rod 11*b* braces the two pistons 11 and the two piston rods 11*a* against each other and against the central abutment block 14, to which it is also attached. The pistons 11 are attached to the central abutment block 14 via the piston rods 11*a*. To be able to work with a single central tie rod 11*b*, the embodiment provides that the abutment block also has an opening 14*a* through which the tie rod 11*b* is guided. The abutment block 14 with the central opening 14*a* is a separate component in this embodiment, and fastened to the lower press part 5 by means of screws.

FIG. 3 furthermore shows that a path measurement system 21 is provided on each piston/cylinder assembly 9*a*, 9*b*, 10*a*, and 10*b*. In this embodiment, the path measurement system 21 is equipped with a precision lead screw and/or formed by a precision lead screw, that extends longitudinally through the respective cylinder and thus determines the relative position between the cylinder housing and the respective piston to effect the positioning of the die and/or monitor the positioning of the die in this manner. These sensor systems 21 are all connected to a common controller 19 (FIG. 1 only) that also operates the various unillustrated pumps and valves that serve to pressurize the compartments of the assemblies 9*a*, 9*b*, 10*a*, and 10*b*.

Figure 5:
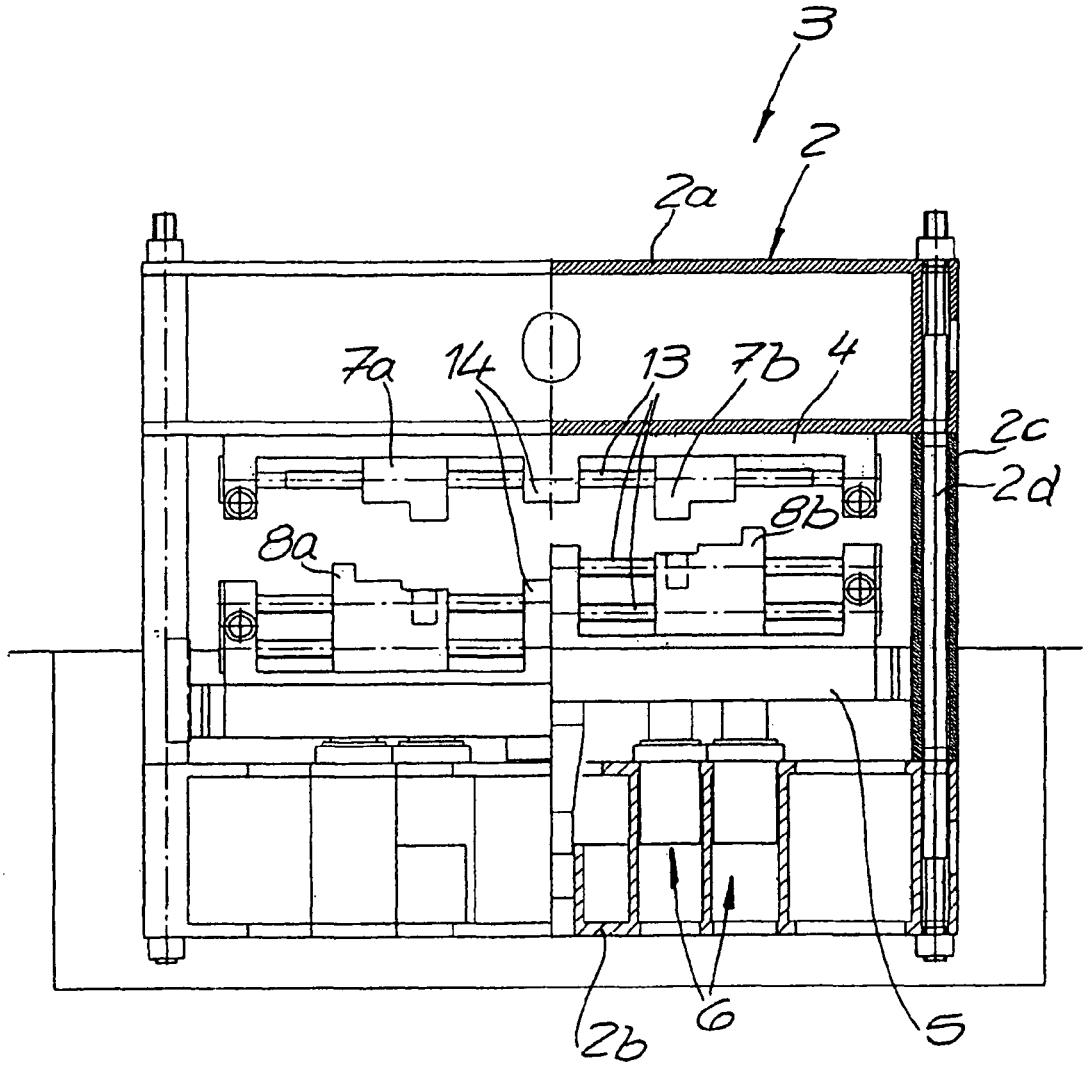
FIG. 5 is another embodiment of the invention, partially in cross-section.
Figure 6:
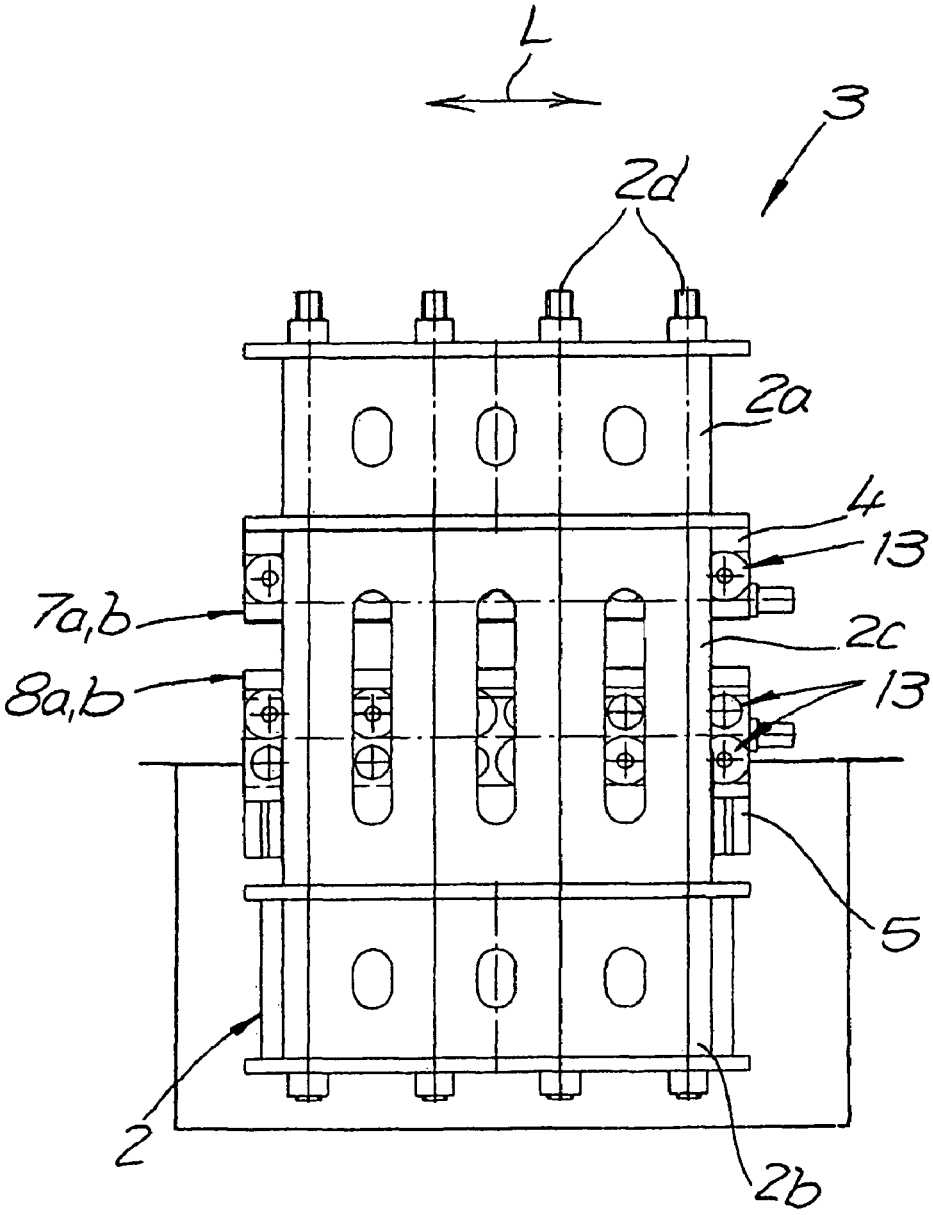
FIG. 6 is a side view of the structure of FIG. 5.

Another embodiment of the invention is shown in FIGS. 5 and 6. This press is also a frame press. However, the frames 2 are each comprised of an upper press element 2*a*, a lower press element 2*b* and side columns 2*c* that are all held together by tie rods 2*d* in the columns 2*c*. This embodiment is furthermore a lower-ram press, i.e. only the lower press platen 5 can be displaced by means of the cylinders 6 toward the fixed upper platen 4. FIG. 5 furthermore indicates the option that the actuators 9*a*, 9*b*, 10*a*, and 10*b* are not hydraulic piston/cylinder assemblies, but rather are spindle drives. In this context, the upper press platen 4 and the lower press platen 5 each again have at least one central abutment block 14 to which the spindle drives are connected with the ends of their spindles 13, that is the spindle ends are fixed against displacement transversely of the direction L but can rotate. The spindles 13, which are rotatably mounted on the press platens 4 and 5, are rotationally driven manually or by an unillustrated electric motor so that the die holders 7*a* and 7*b*, 8*a* and 8*b* are displaced along the spindles 13.

A combination of the embodiment according to FIGS. 1 and 2 and/or FIGS. 3 and 4 on the one hand, and the embodiment according to FIGS. 5 and 6 on the other hand, is also possible. This means, for example, that a column press can also be provided with hydraulic actuators and a frame plate press can be provided with spindle drives. The setup as upper- or lower piston press is variable.

FIG. 1 to 6 show preferred embodiments of the invention where the position of the upper and lower die holders is adjusted transversely to the longitudinal direction of the press by means of actuators.

Figure 7:
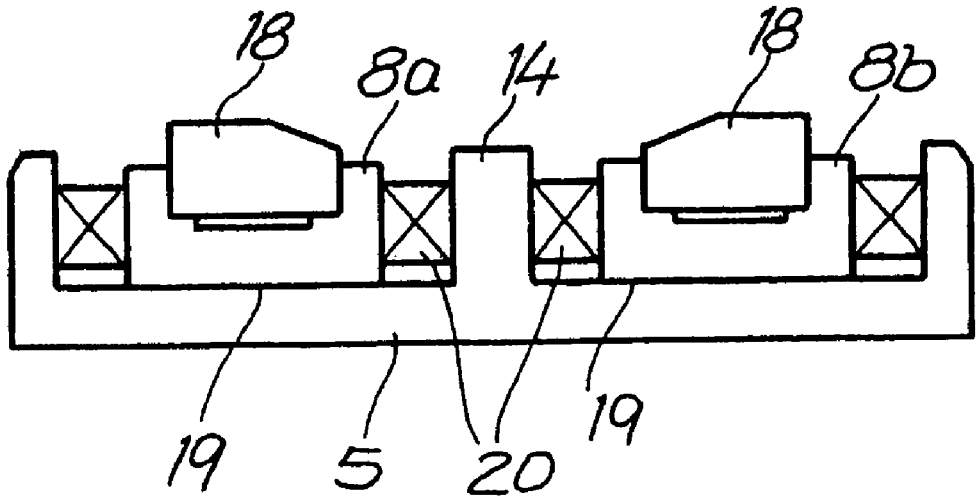
FIG. 7 is a section through a modified embodiment of the invention.

FIG. 7 shows a (simplified) modified embodiment of the invention where the position of the die holders can also be adjusted, but without the use of actuators. FIG. 7 shows only the lower press platen 5 of this type of press, having a basic structure that can correspond to the presses according to FIG. 1 to 6. FIG. 7 shows that no actuators are used. Instead, the die holders 8*a* and 8*b* can be (freely) displaced on support surfaces to adjust a desired position. The adjusted position is then locked in by using one or more spacer blocks and/or spacers 20 that lock the holders 8*a* and 8*b* in place and support them on the press platen 5. This embodiment also provides for a central abutment block 14. To that end, the press platen 4 is essentially M-shaped and/or W-shaped, as in the embodiment according to FIG. 5.

We claim:

1. A press for crimping longitudinal edges of a plate for the manufacture of pipe, the press comprising:

a closed press frame;

an upper press platen and a lower press platen extending longitudinally through the frame;

a pair of transversely spaced and transversely shiftable upper supports on the upper platen;

a pair of transversely spaced and transversely shiftable lower supports on the lower platen;

respective upper dies fixed in the upper supports and having downwardly directed lower faces;

respective lower dies fixed in the lower supports and having upwardly directed upper faces;

a piston/cylinder assembly braced between the frame and one of the platens and pressurizable to shift the one platen vertically toward the other of the platens.

2. The crimping press defined in claim 1, further comprising:

respective actuator means engaging the holders for transversely shifting the respective holders.

3. The crimping press defined in claim 2 wherein each of the actuators includes a transversely extending threaded spindle member and a nut member threaded on the spindle, one of the members of each actuator means being fixed to the respective platen and the other member of each actuator means being fixed to the respective holder.

4. The crimping press defined in claim 2 wherein each of the actuator means is a transversely extensible and contractile piston/cylinder assembly.

5. The crimping press defined in claim 4 wherein the actuator means are each braced between the respective platen and the respective holder.

6. The crimping press defined in claim 4 wherein each piston/cylinder assembly has a cylinder and a piston movable therein, the pistons being fixed to the respective platens and the cylinders being fixed to the respective holders, whereby each cylinder shifts transversely jointly with the respective holder.

7. The crimping press defined in claim 6 wherein each of the platens has between the respective holders a central abutment block that is transversely nondisplaceable on the respective platen, the pistons being braced against the respective abutment blocks.

8. The crimping press defined in claim 7 wherein the piston rods are at least partially tubular, the press further comprising upper and lower tie rods extending transversely through the piston rods and having outer ends anchored in the respective pistons.

9. The crimping press defined in claim 8 wherein the abutment blocks are formed with transversely throughgoing passages through which the respective tie rods extend.

10. The crimping press defined in claim 9 wherein the tie rods are each fixed in the respective abutment block.

11. The crimping press defined in claim 4 wherein the piston/cylinder assemblies each have a pair of compartments flanking the respective piston and therefore are double acting, the press further comprising hydraulic control means for pressurizing compartments of the assemblies and for hydraulically locking the assemblies by preventing fluid movement into and out of the compartments during closing of the press and deformation of the plate.

12. The crimping press defined in claim 1, further comprising means on one of the platens for clamping the plate against movement during closing of the press.

13. The crimping press defined in claim 1 wherein the press has a row of such closed press frames, the platens extending longitudinally through the row of frames.

14. The crimping press defined in claim 1 wherein the frame is annular and has a transversely extending upper beam above the upper platen, a transversely extending lower beam below the lower platen, and two vertical columns extending between the upper and lower beam and transversely flanking the platens.

15. The crimping press defined in claim 1 wherein the faces of the dies are generally part-cylindrical and the lower-die faces are complementary to the upper-die faces.

16. The crimping press defined in claim 15 wherein the lower dies are upwardly concave and the upper dies are downwardly convex.

* * * * *